US006322717B1

(12) United States Patent
Murakami

(10) Patent No.: US 6,322,717 B1
(45) Date of Patent: Nov. 27, 2001

(54) METHOD OF PROCESSING LEATHER MATERIAL, LEATHER MATERIAL THUS PROCESSED AND LEATHER PRODUCT USING LEATHER MATERIAL THUS PROCESS

(76) Inventor: Keiko Murakami, 19-14, Izumi, Abiko-shi, Chiba, 270-1142 (JP)

( * ) Notice: Subject to any disclaimer, the term of this patent is extended or adjusted under 35 U.S.C. 154(b) by 0 days.

(21) Appl. No.: 09/333,179

(22) Filed: Jun. 14, 1999

(30) Foreign Application Priority Data

Jun. 16, 1998 (JP) ..... 10-183258

(51) Int. Cl.[7] ..... C14C 9/00

(52) U.S. Cl. ..... 252/8.57; 8/94.15; 8/94.19 R; 428/473; 427/389; 427/412; 72/343

(58) Field of Search ..... 252/8.57; 428/473; 427/389, 412; 72/343; 8/94.15, 94.19 R

(56) References Cited

U.S. PATENT DOCUMENTS 6,022,838 * 2/2000 Kuwabara et al. ..... 8/436
6,133,372 * 10/2000 Lohmnn et al. ..... 524/745

* cited by examiner

*Primary Examiner*—Yogendra N. Gupta
*Assistant Examiner*—Derrick G. Hamlin
(74) *Attorney, Agent, or Firm*—Rosenthal & Osha L.L.P.

(57) ABSTRACT

A processing method of a leather material having grains thereon is disclosed. The processing method of the leather material includes: the first step of sammying a tanned leather material by hand; the second step of moistening the leather material; and third step of partially heating the leather material from the back to create grains thereon. The leather material may be folded at the position where the grains are created so that a relatively large convexity is formed. The invention also discloses a leather material thus processed as well as a leather product produced by using the leather material thus processed.

7 Claims, 6 Drawing Sheets

METHOD OF PROCESSING LEATHER MATERIAL, LEATHER MATERIAL THUS PROCESSED AND LEATHER PRODUCT USING LEATHER MATERIAL THUS PROCESS

FIELD OF THE INVENTION

This invention relates to a processing method of a leather material and a leather material thus processed and a leather product produced by using the leather material thus processed.

BACKGROUND OF THE INVENTION

Up to this time, various leather products such as bags or bracelets produced by using the skin of animals like cows have been known on the market. These leather products are formed in various shapes by processing leather materials by sewing, physically folding, twisting or pressing. In addition, ornamental designs are applied on the leather products by creating grains by using these methods.

However, according to these conventional methods, the shape of the grains created on the leather skin has to be limited to man-created ones and the deformation of the leather skin created by these method is not permanent. Therefore, the ornamental effect which can be achieved by these conventional methods is limited.

Further, since it has not been possible to create a large convexity by performing a permanent deformation processing to the leather skin, the effect of creating concavity-convexity shapes to the leather skin to create an ornamental design is also limited.

SUMMARY OF THE INVENTION

It is an object of the present invention to provide a processing method of a leather material and provide a leather material thus processed as well as a leather product produced by using the leather material thus processed by creating permanent grains in various natural shapes on the leather materials to achieve an ornamental effect which has never been achieved so far.

In order to achieve the above object, the present invention provides a processing method of a leather material comprising:

a first step of sammying a tanned leather material;

a second step of moistening the leather material; and third step of partially heating the leather material from the back thereof According to the processing method of the present invention, grains are created on the surface of the leather material in the third step by partially heating the back of the leather material which has already undergone the first and the second processing step of the present invention. The deformation of the leather material by the grains thus created is permanent and the shape of the leather material thus formed can be maintained semi-permanently without applying any physical force.

The term "surface of the leather material" herein used means the outer surface of the membrane covering the outside body of the animal from which the leather material is obtained. The term "back of the leather material" herein used means the opposite side of the "surface of the leather material".

In addition, since the grains created on the leather material by the third step of the present invention is formed in a natural, not man-created, shape by a permanent deformation processing, any other special processing for physically creating grains on the surface of the leather material is unnecessary and a novel ornamental effect can be achieved.

Further, by creating permanent grains on the surface of the leather material, the leather material may be folded at the positions where the grains are created. Therefore, a relatively large convexity may be freely formed on the leather material.

In the above processing method, at least one of the length (width), pitch, depth and direction of the grains may be changed by changing at least one of the following: a position of leather material; thickness of the leather material; the method of moistening the leather material in the second step; the area of heating in the third step; heating temperature in the third step; and a heating time period in the third step.

By making these changes, various grains having different sizes and shapes are created on the leather material. By changing the grains into various shapes, the ornamental effect may be optionally changed accordingly. "The portion of the leather" herein used means the portion of the skin of the animal from which the leather material to be used is obtained, such as abdomen, back, leg and the like. The moistening of the leather material may be performed by dipping the leather material in water, spraying water to the leather material or applying water by a brush. As the leather material of the present invention, any skins of animals including, but not limited to, cows, pigs, sheep and crocodiles may be used.

One embodiment of the leather material processed according to the present invention comprises grains created thereon by heating the leather material from the back thereof Because the grains on the leather material created by the method of the present invention is permanently formed in a natural, not man-created, shape, a novel ornamental effect which has never been achieved in the processing of leather materials so far may be achieved.

Another embodiment of the leather material processed according to the present invention further comprises a convexity formed by folding the leather material at the position where the permanent grains are created by using the processing method of the present invention.

According to this embodiment, a relatively large convexity are freely formed by the leather material by folding the same at the position where the grains are created in a manner that the surface of the leather material being the top of the convexity thus formed.

By creating a convexity to the leather material according to this method, a novel ornamental effect is achieved by the processing of leather materials. Also, it becomes possible to produce artistic handicrafts by using leather materials by freely forming concavities-convexities thereon.

Further, according to the leather product produced according to the present invention, because of the existence of the grains permanently formed in a natural, not man-created, shape or the relatively large convexity, a novel ornamental effect may be achieved in the leather products thereby enhancing the value of those leather products.

BRIEF DESCRIPTION OF THE DRAWINGS

FIG. 3(*b*) is another perspective view of an ornamental portion of a pendant produced according to the processing method of the present invention.

FIG. 4(*b*) is another perspective view of an ornamental portion of a pendant produced according to the processing method of the present invention.

DETAILED EXPLANATION OF THE EMBODIMENTS OF THE INVENTION

Referring now the drawings, the embodiments of the present invention are explained in detail.

Figure 1:
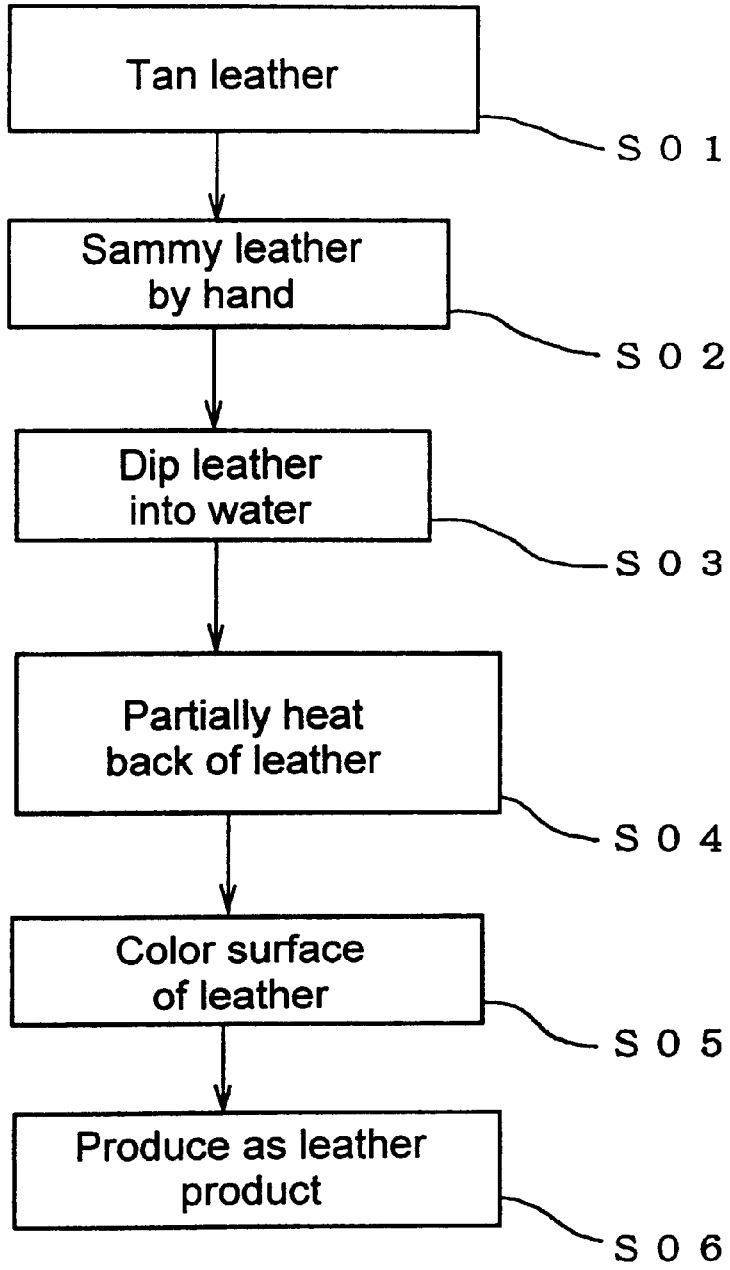
FIG. 1 is the flow chart showing the steps of the processing method of the leather material and the leather product according to the present invention.

The processing method of the leather material and leather products according to an embodiment of the present invention is explained by referring the flow chart of FIG. 1.

First, obtain a leather material by tanning the skin of an animal such as a cow by using a plant tannin tanning method (S01). Next, sammy the leather thus obtained by hand (S02), and thereafter dip the leather in a water tank (S03). Then, picking out the leather from the water tank, partially apply an electric iron to the back of the moistened leather (S04). By applying the electric iron to the back of the leather and partially heating the same, the back of the leather is shrunk to create wrinkles at the heated position, and thereby grains are created on the surface of the leather. By following these steps, a leather material having grains formed in an appropriate shape thereon is produced.

In order to tan the skin, other methods such as a chrome tanning method may be used depending on the kinds of the animal skins to be used. The heating of the leather by electric iron should be performed at an appropriate temperature and time period so that the leather material is not scorched. The top end of the electric iron to be used to heat the leather is preferably formed in a round shape. Sammying the leather by hand (S02) may be performed by putting the leather in a container and shaking the same. By performing this method, the effect of sammying the leather material is enhanced.

Next, the surface of the leather material having grains thereon is colored taking into consideration of the design of the leather product, and a transparent protective coating such as a glue is applied thereon (S05). Thereafter, using the leather material thus processed, the intended leather product is produced by performing those processing such as cutting, folding, sewing or fixing metal fittings (S06).

Among the above steps, creation of grains by partially heating the back of the leather material may be performed after coloring the surface of the leather material. In that case, the protective coating should be applied after creation of the grains. Also, coloring the surface of the leather may be conducted after production of the leather product. Coloring may be conducted by dipping the leather material having grains thereon into a dye solution. It is also possible to draw a pattern on the surface of the leather by using gold leaf, silver leaf or other coloring elements. It is also possible to produce the leather product without coloring, thereby making the most of the natural color of the leather material.

Figure 5:
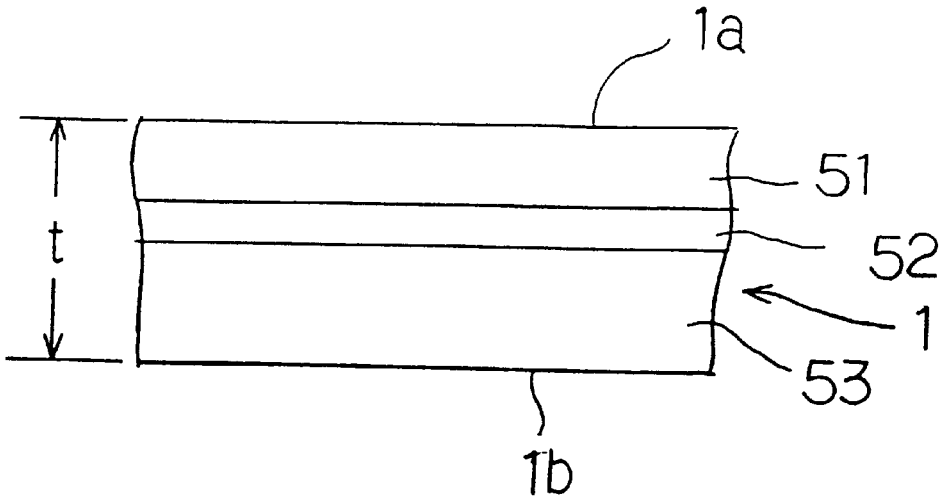
FIG. 5 is a typical sectional view of the leather material obtained from a cow.

Next, by referring FIG. 5, the effect of the processing of the leather material in each of the above described steps (S02–S04) is explained in detail.

FIG. 5 shows the cross sectional view of the structure of the leather material 1 obtained from a cow. The leather material is comprised of silver face layer 51 at the surface (silver face) side 1*a* and reticulate layer 53 at the back side 1*b* being interposed by a boundary layer 52. The reticulate layer 53 is formed of a fibrous structure having thick and strong fibers interlocking to each other. By sammying the leather by hand in Step S02, the reticulate layer 53 becomes soft, and more spaces are created in the fibrous structure. By this processing, there is created a "mother" of the grains in the reticulate layer 53.

At the subsequent step S03, water is applied to the leather from the back thereof to fill in the many spaces created between the fibers of the fibrous structure 53. When heated by the electric iron from the back 1*b* of the leather at the next step S04, the water filled in the spaces in the reticulate layer 53 is evaporated. As the result, the fibers in the reticulate layer 53 get close to each other, thereby forming a dense structure. In the course of this processing, the spaces between those fibers disappear, causing shrinking of the back of the leather 1*b* and resultantly forming wrinkles to create grains on the surface of the leather material 1.

At the step S03, it is enough that the back of the leather material merely gets wet with water. Therefore, it is preferable that the leather dipped in the water tank is removed therefrom in a short period of time. For moistening the leather, other means such as spraying water or applying water with a wet brush may be employed. It is enough that water is applied only to the back 1*b* of the leather material. The water applied to the back of the leather material prevents the leather from being scorched when heated by the electric iron. Heating means other than the electric iron may be used to heat the leather material in Step S04. For instance, a hot iron, a hot air blower such as dryer or a flame throwing apparatus such as burner may be used.

Figure 2:
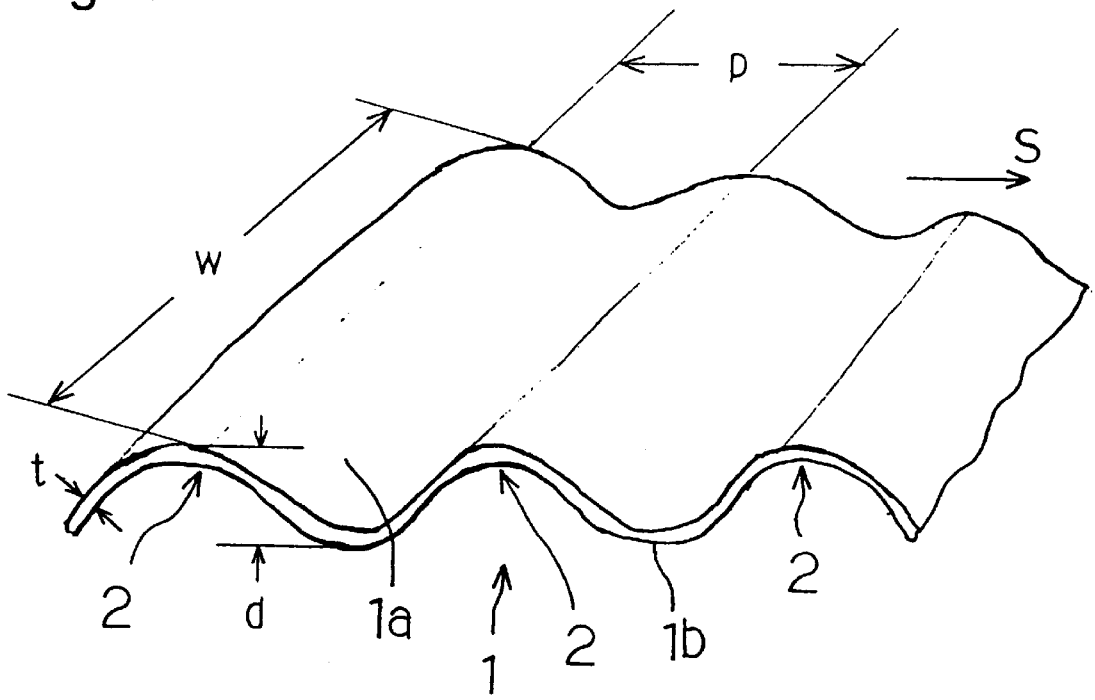
FIG. 2 is a partial perspective view of the grains of the leather material created according to the processing method of the present invention.

FIG. 2 shows the partial perspective view of the leather material 1 having grains thereon created in a manner as described above. By partially heating the leather material 1 from the back 1*b* thereof, the heated areas are shrunk to form swellings of the leather material thereby creating a plurality of grains 2 thereon. In this case, the approximate shape and size of the grains 2 are indicated by length (width) w, depth d, pitch p and direction of shrinking s. These shapes and sizes may be formed by appropriately determining the portion of leather material to be used, thickness of the leather material (t in FIG. 2), the method of applying water in the step S03, the areas of the leather material to be heated in S04, heating temperature and combining these elements so that the intended shape and size of the leather material are achieved. The width (length) w of the grains is approximately determined in accordance with the width (length) of the back of the leather to be heated. Also, the depth d of the grains 2 is determined depending on the thickness t of the leather material 1 and can be set approximately in a range from 1.5 to 3 times of thickness t.

The term "the portion of the leather material" means the portion of the skin of animal from which the leather to be used is obtained. Since the fibrous structure around the surface of the leather material such as fibrous direction differs depending on this "portion of the leather material", the direction of the grains of the leather material becomes different depending on the kinds of the "portion of the leather material" to be used.

Figure 3:
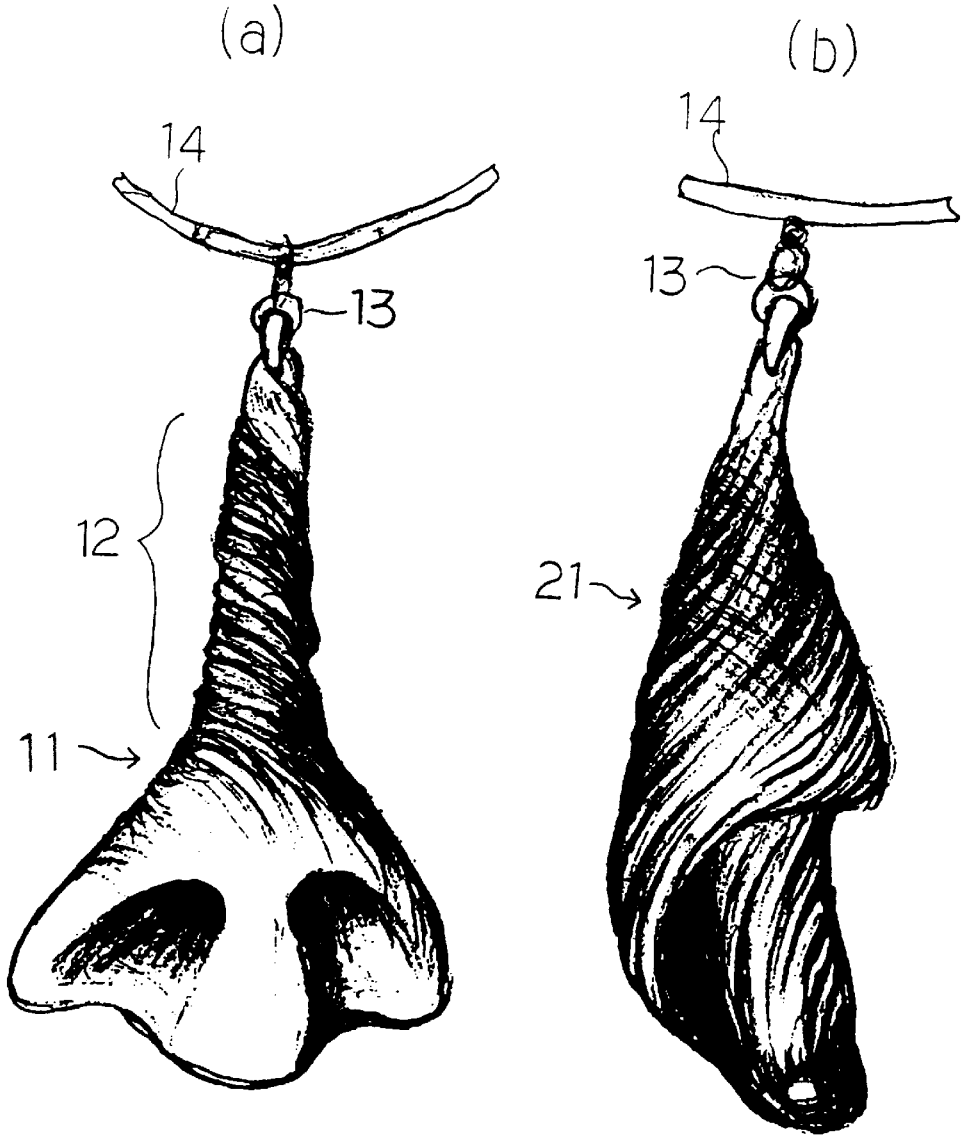
FIG. 3(*a*) is a perspective view of an ornamental portion of a pendant produced according to the processing method of the present invention.
Figure 4:
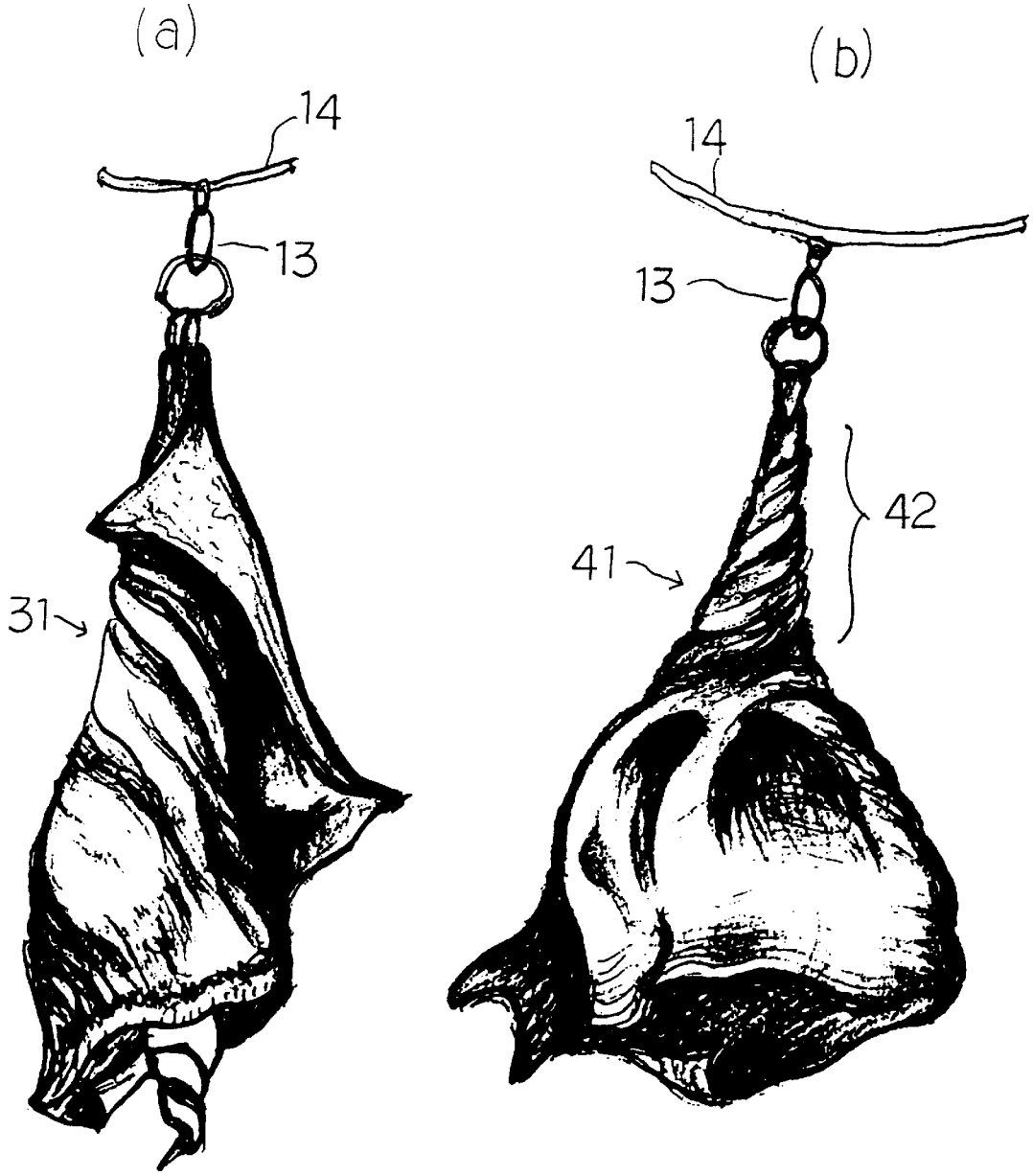
FIG. 4(*a*) is another perspective view of an ornamental portion of a pendant produced according to the processing method of the present invention.

Next, referring FIGS. 3 and 4, specific examples of the leather product produced by using the leather material having the grains created by the method as described above are explained.

FIGS. 3(*a*), (*b*) and FIG. 4(*a*), (*b*) are the perspective views of the pendants having an ornamental portion produced by using the leather material thus processed.

The pendant as shown in FIG. 3(*a*) comprises the ornamental portion 11 having a grain portion 12 wherein grains are relatively densely created in a spiral shape, the metal fitting 13 in a ring shape being connected to this ornamental portion 11, and the chain 14 in a string shape being connected to this metal fitting 13.

The pendants as shown in FIG. 3(*b*) and FIGS. 4(*a*), (*b*) respectively comprise the ornamental portions 21, 31 and 41 produced by the leather materials having grains in different shapes. Other portions than the ornamental portion are formed equally to those of FIG. 3(*a*).

The above ornamental portions 11, 21, 31 and 41 are produced according to the above processing method by using the leather material having the thickness (shown as t in FIG. 2) of 0.5–1.1 mm obtained from a skin of a cow tanned by using the tannin tanning method.

By conducting this processing, the whole body of the ornamental portion is formed in a curled shape. The surface of the ornamental portion is colored and coated with a protective coating.

In the ornamental portion 11 of FIG. 3(*a*), the grains of the grain portion 12 are formed relatively densely. On the other hand, in the ornamental portion 41 of FIG. 4(*b*), the grains of the grain portion 42 are formed relatively roughly. This difference of the grains used in the ornamental portions can be achieved by, for instance, using a relatively thin leather material for the one in FIG. 3(*a*) and using a relatively thick leather material for the one in FIG. 3(*b*). Also, pitch p of the grains can be changed by changing the size of the areas to be heated.

Those pendants having the ornamental portions 11, 21, 31 and 41 achieve a novel ornamental effect by having grains formed in a natural, not man-created shape while using a natural leather material, thereby enhancing the value of the pendant.

Figure 6:
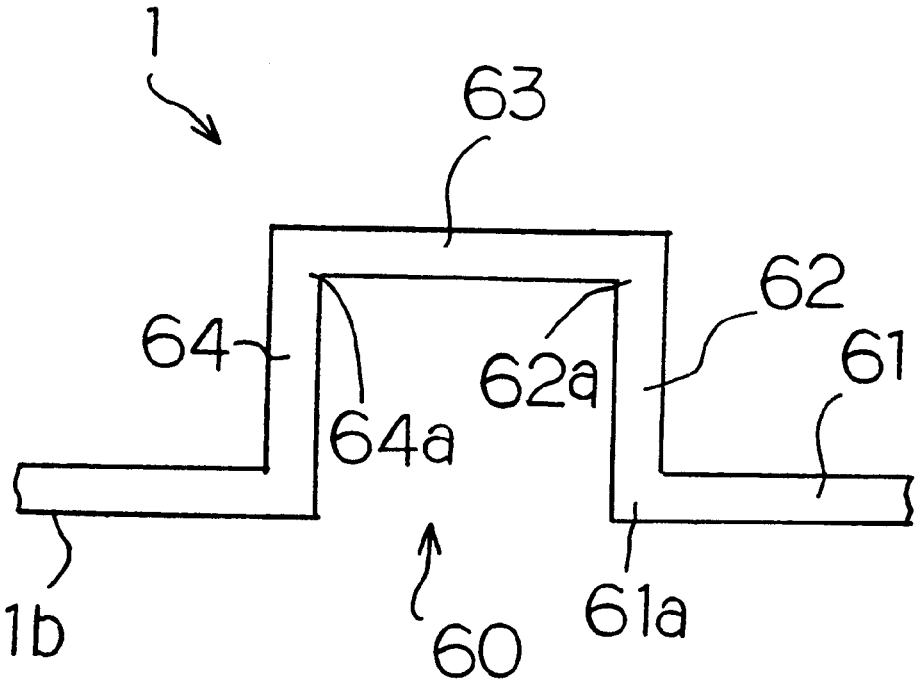
FIG. 6 is a typical sectional view of the convexity formed by a leather material.

Next, referring FIG. 6, the method of forming a relatively large convexity by folding the leather material according to the above described processing method is explained.

As shown in FIG. 6, a certain area 61*a* of the back 1*b* of the leather material 1 is heated. By this heating, the reticulate layer 53 (FIG. 5) at the area 61a is shrunk, and as the result of the shrinking of the reticulate layer 53, the silver layer (FIG. 5) of the leather material 1 is deformed to create a grain in an approximately convex shape. Thereafter, the leather material 1 is folded at the area 61 a to form the bottom portion 61 and the perpendicular portion 62. In the same way, the area 62*a* at the back lb of the leather material 1 is heated and thereafter the leather material 1 is folded at the area 62*a* to form a horizontal portion 63. Subsequently, the area 64*a* is heated to form another perpendicular portion 64 in the same manner.

By processing the leather material 1 as described above, a convexity 60 is formed. Heating the area 62*a* and 64*a* may be omitted depending on the desired shape of the convexity 60.

The height of the perpendicular portion 62 as described above may be optionally determined. Also, the folding angle of the perpendicular portion 62, 64 and horizontal portion 63 may be optionally determined. Therefore, the shape of the convexity 62 may be changed three dimensionally as well as horizontally.

By this method, the leather material may be formed in an optional concavity-convexity shape. Therefore, for instance, an artistic handicraft using the leather material 1 having various concavity-convexity shapes thus formed may be produced. This method may also be applied to other leather products.

In the conventional artistic handicraft production using leather materials, the expression of such art has been limited owing to the inability to make a large undulation to the leather material. However, the processing method of the present invention eliminates such limitation and enables to create concavities-convexities in optional shapes on the leather material thereby making it possible to produce various artistic handicrafts and leather products by using leather materials.

The leather products of the present invention may be any products which are produced from leather materials including, but not limited to, pendants, wallets, commutation ticket holders, bags, clothes, hats, belts, necklaces, finger rings, brooches, bracelets, shoes, key holders or other single production artistic handicrafts.

What is claimed is:

1. A method of processing a leather material, comprising:

a first step of sammying a tanned leather material;

a second step of moistening the leather material; and a third step of applying heat to a predetermined position of the leather material from a back thereof to permanently deform the leather material in a desired shape.

2. The method according to claim 1, wherein said heating of the leather material is conducted by using an electric iron.

3. The method according to claim 1, further comprising a fourth step of creating a convexity by folding the leather material at a position where the leather material is heated.

4. A method of processing a leather material, comprising:

tanning and sammying a leather material comprising a reticulate layer having a fibrous structure;

moistening the reticulate layer of the leather material; and applying heat to a predetermined position of the reticulate layer of the leather material in a manner that swelling is formed on a surface of the leather material in a desired shape.

5. The method according to claim 4, wherein the leather material is heated by using an electric iron.

6. A method of processing a leather material, comprising:

tanning and sammying a leather material comprising a reticulate layer having a fibrous structure;

moistening the reticulate layer of the leather material;

applying heat to a predetermined position of the reticulate layer of the leather material; and folding the leather material at the predetermined position in a manner that the leather material is permanently deformed in a convex shape.

7. The method according to claim 6, wherein the leather material is heated by using an electric iron.

* * * * *